United States Patent [19]

Vijuk

[11] Patent Number: 5,046,710

[45] Date of Patent: Sep. 10, 1991

[54] FOLDED LEAFLET AND METHOD AND APPARATUS FOR MAKING SAME

[75] Inventor: Robert Vijuk, Downers Grove, Ill.

[73] Assignee: Vijuk Equipment, Inc., Elmhurst, Ill.

[21] Appl. No.: 327,543

[22] Filed: Mar. 23, 1989

Related U.S. Application Data

[62] Division of Ser. No. 5,422, Jan. 20, 1987, Pat. No. 4,817,931.

[51] Int. Cl.[5] ..... B41L 43/12

[52] U.S. Cl. ..... 270/37; 270/45; 493/231; 493/249; 493/352; 493/356; 156/357; 156/204; 156/227; 156/269; 156/443

[58] Field of Search ..... 270/32, 37, 38, 45, 270/47; 493/405, 408, 419, 420, 421, 422, 436, 409, 430, 431, 231, 243, 249, 355-360, 376-399; 156/226, 227, 357, 443, 447, 200, 204, 578, 269

[56] References Cited

U.S. PATENT DOCUMENTS

| | | | |
|---|---|---|---|
| 3,511,013 | 5/1970 | Pahlitzsch | 270/37 |
| 3,917,251 | 11/1975 | De Lise | 270/37 |
| 4,616,815 | 10/1986 | Vijuk | 270/45 |
| 4,812,195 | 3/1989 | Vijuk | 270/37 |

FOREIGN PATENT DOCUMENTS

| | | | |
|---|---|---|---|
| 2456695 | 1/1981 | France | 270/37 |

*Primary Examiner*—Edward K. Look
*Assistant Examiner*—Therese M. Newholm
*Attorney, Agent, or Firm*—Marvin N. Benn; Thomas B. Lindgren; Milton S. Gerstein

[57] ABSTRACT

A method and apparatus are disclosed for making a leaflet having fold lines and cross folds normal to the fold lines and with an adhesive adhering a lip portion of a long leg of the leaflet to a short leg of the leaflet to avoid leaving a loose edge on the leaflet. Sheets are conveyed in a first direction to a first folding at a first folding station, and then a second conveyor feeds the sheets to travel at right angles to a cross folder at a second folding station. The cross folds are made to a lip portion on a long leg and adhesive applicator applies adhesive to the lip portion which is adhered by the adhesive to a folded panel to form a leaflet having fold lines and cross folds at its edges, thereby eliminating any loose edges. Loose edges may open the leaflet during a high speed conveyance thereof.

9 Claims, 6 Drawing Sheets

FOLDED LEAFLET AND METHOD AND APPARATUS FOR MAKING SAME

This is a division, of application Ser. No. 07/005,422, filed Jan. 20, 1987, U.S. Pat. No. 4,817,931.

This invention relates to a novel folded leaflet having interior portions adhered to each other to form a closed leaflet and to a method and apparatus for making the same.

BACKGROUND OF THE INVENTION

The present invention is directed to making folded leaflets which have panels thereof glued or otherwise adhered together to form a closed leaflet which, in some instances, is called an "outsert" if the leaflet contains instructional directions for the use of a pharmaceutical product with which the leaflet is packaged and, in other instances, is merely called a "leaflet" when, for example, the leaflet is used in the food industry.

The present invention will be described hereinafter in connection with its preferred use which is to provide instructions for the making of a food product from the material such as a dessert gelatin. While high speed operations are generally used to dispense outserts in a packaging operation for the pharmaceutical industries, even higher speeds of operation are needed to dispense closed folded leaflets in a packaging operation in the food industries in which leaflets should be dispensed and packaged at speeds of 20,000 to 36,000 per hour.

In forming closed leaflets for later dispensing at such speeds, it is important that the loose edges or loose panels of the leaflets be directed downstream of the traveling folded sheet so as not to catch air and lift or flutter and cause jamming of the equipment. Further, the completed closed leaflet preferably is formed with all of the loose panels or loose edges on the inside of the leaflet and with only folded edges all the way around the outside of the leaflet to prevent air from catching and lifting a single panel when the leaflet is fed at high speeds to and through the packaging equipment. Thus, the preferred leaflet has a double sheet thickness on the outside and folded edges all around with the outer sheet panel being held down by the inner sheet panel to which it is joined at the folded edges. The method and apparatus herein disclosed is directed not only to a folding design which can be achieved at very high speeds but also a gluing design whereby the panels may be glued together to form the completed closed leaflet useable with high speed packaging equipment.

One previously known attempt to glue folded leaflets included in the step of cutting a hole in an interior middle folded section of the leaflet and applying glue to an outer adjacent section at the hole location so that the glue could project through the hole to be adhered to a folded section on the other side of the middle panel. Manifestly, the cutting of holes in the sheets is an operation to be avoided and the leaflet, when unfolded, is marred by unsightly holes. Other closed leaflets have been formed but at low speeds or with configurations that do not permit their subsequent feeding at very high speeds in high speed packaging equipment. Thus, there is a need for a commercial method and apparatus for folding and gluing folded sheets at high speeds of 400 to 600 per minute and, in a folded adhered leaflet of a design, that can be subsequently packaged at similar speeds. To be commercially acceptable, the apparatus should be relatively trouble-free and capable of operating for long periods of time with little down time for maintenance or clearance of janiming of paper in the apparatus.

Accordingly, a general object of the invention is to provide a new and improved folded leaflet of the above-described kind.

Another object of the invention to provide high speed method and apparatus for folding and gluing leaflets having first folds in a first direction and cross folds extending normal to the first folds to form a complete closed leaflet preferably with closed edges entirely around the outside of the leaflet.

These and other objects and advantages of the present invention will become apparent from the following detailed description taken in conjunction with the accompanied drawings in which

DESCRIPTION OF THE PREFERRED EMBODIMENT

Figure 9:
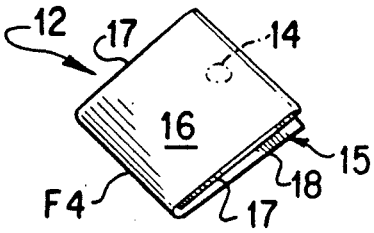
FIG. 9 is a view of a complete and folded leaflet.

As shown in the drawings for purposes of illustration, the invention is embodied in a method and apparatus 10 which is to make a closed folded instructional leaflet 12 such as shown in FIG. 9, which has a glue spot 14 which adheres an inner side of a first half or section 15 to an opposed half or section 16 to provide tightly closed, thin leaflet as shown in FIG. 9. As will be described hereinafter in greater detail, each of the glued closed leaflet halves is preferably formed with folded edges 17 and 18 on the outside of the leaflet so that there are no single edges or panels exposed on the outersides of the leaflet.

Figure 2:
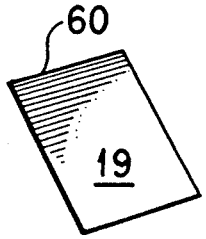
FIG. 2 is a perspective view of a sheet to be folded into a leaflet.
Figure 6:
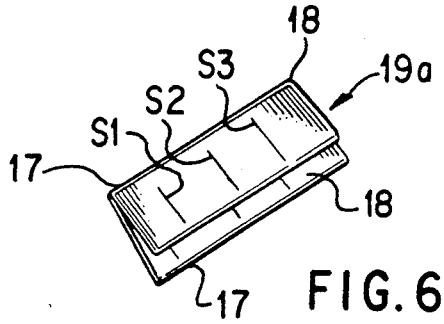
FIG. 6 is a view of the folded sheet being fed toward the second folding station.
Figure 3:
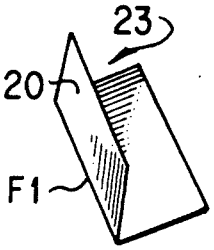
FIG. 3 is a view of the sheet having a first fold therein.
Figure 4:
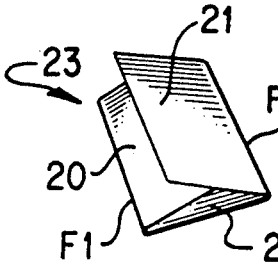
FIG. 4 is a perspective of the sheet folded with three panels and two fold lines.
Figure 8:
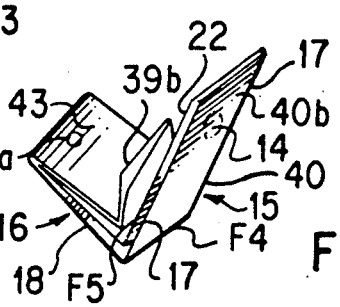
FIG. 8 illustrates a second cross fold on the long and short legs.

Heretofore, the problem has been that it has not been possible to fold leaflets to provide a complete closed package or leaflet 12 at very high rates of speed needed, such as, for example, 20,000 to 36,000 leaflets per hour from a single machine. When feeding sheets 19 (FIG. 2) at such speeds to form all of the necessary folds and cross folds and to complete the gluing operation, the sheets need to be carefully controlled so that a single leaf or panel such as the panel 20 or 21 shown in FIGS. 3 and 4 does not lead in the feeding direction such that air would be caught in a groove 23 between adjacent panels and lift the panel 20 or 21 and hence not properly feed into and through subsequent stations. At lower speeds, such consideration may not be important. Additionally, there is the problem of how to design the leaflet so that there is not a loose panel or edge 22, such as shown in FIG. 8 on the outside which could become caught or which air could lift. By having the loose panels within the package, there is less opportunity for such a loose edge to be caught when the leaflets are being fed and packaged with the product in high speed packaging equipment.

Figure 5:
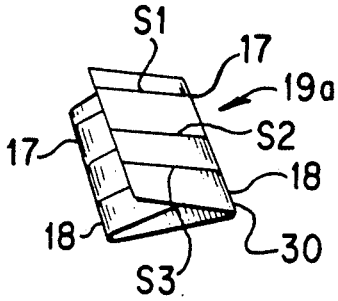
FIG. 5 is a view of the sheet having been scored at the first folding station.

In accordance with the present invention, there is provided a new and improved apparatus 10 which feeds sheets at high speeds and forms the final glued, closed leaflet at high speeds in a commercially acceptable manner. To this end, the sheets are carried forwardly from a first feeder 25 by a conveyor 26 to a first folding station 27 at which is located a first folding means 28. At the first folding station, the first folding means folds the sheet 19, which is shown in its unfolded state in FIG. 2 and forms two folds at fold lines F1 and F2 resulting in three panels 20 and 21 and 29 each being equal in size in this instance. From the first folding station, the now folded sheet 19*a*, as shown in FIG. 5 is then fed with a folded edge 30 leading in the direction of travel to a transfer station 32 at which the sheet is discharged from a conveyor 33 onto a cross conveyor 34 running at right angles to convey the folded sheet in the long direction of its folded length to a second folding station 35 at which is located a folder 36 which first forms a cross fold F3 to form a short leg 39 and a long leg 40 and then as shown in FIG. 8 to form a second cross fold F4 in the long leg and an equal cross fold F5 in the short leg thereby forming the folded halves 16 and 17 held together by the internal glue spot 14 so that the completed closed leaflet 12 has the completed leaflet shape shown in FIG. 9. In the preferred embodiment of the invention there is a stacker 41 which automatically stacks the leaflets on edge and in a row, one behind the other, for putting in boxes or for conveying to equipment to be combined with the food product or the pharmaceutical product.

Figure 7:
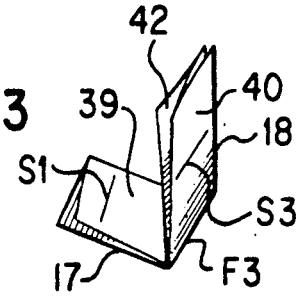
FIG. 7 is a view of the folded sheet having been formed with the first cross fold normal to the first and second fold lines.
Figure 7A:
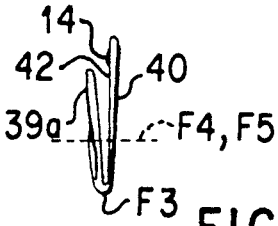
FIG. 7A is a side view of FIG. 7.

Forming of the short legs 39 and the long leg 40, as best seen in FIG. 7A, allows the formation of a lip or area 42 which is the area on the long leg extending upwardly beyond the adjacent edge 39*a* of the short leg 39 as best seen in FIG. 7*a*, and the glue spot 14 is carried on the lip 42. Thus, when the next fold F4, F5 is made, the glue spot 14 is able to project across the upper edge 39*a* to engage a panel 43 at the spot 14*a* shown in FIG. 8. Thus, the two halves are glued together at a location above the section 39*b* (FIG. 8). If the legs were the same length, then sections 40*b* and 39*b* would be glued immediately rather than the gluing step waiting until the folds F4 and F5 are made and the glue spot can project over the top of the panel 39*b*.

While it is possible to provide a gluing station 45 at the folding station, herein it is preferred to provide the gluing station 45 (FIG. 10) immediately prior to the second folding station 35 and to use a power-operated adhesive applicator 50, such as a solenoid-operated gluing nozzle 51 which applies adhesive spot 14 prior to any of the folding at the second folding station. As will be explained hereinafter in greater detail, the preferred and illustrated fold rollers at the second station 35 are grooved so that no pressure is applied and no contact made at the glue spot 14 as would result in glue accummulating on the rollers.

Figure 1:
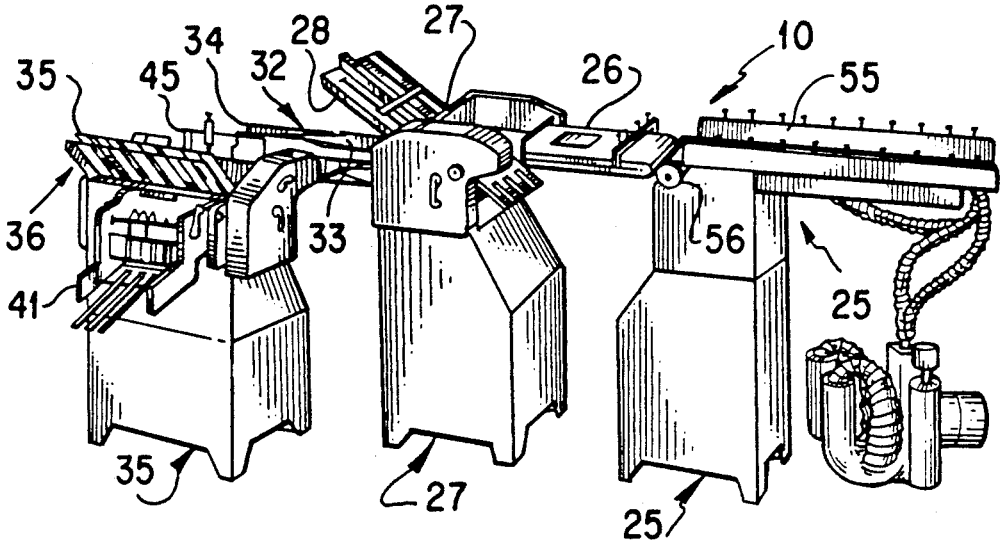
FIG. 1 is a perspective view of an apparatus for making the leaflets and practising the preferred method of the invention.
Figure 11:
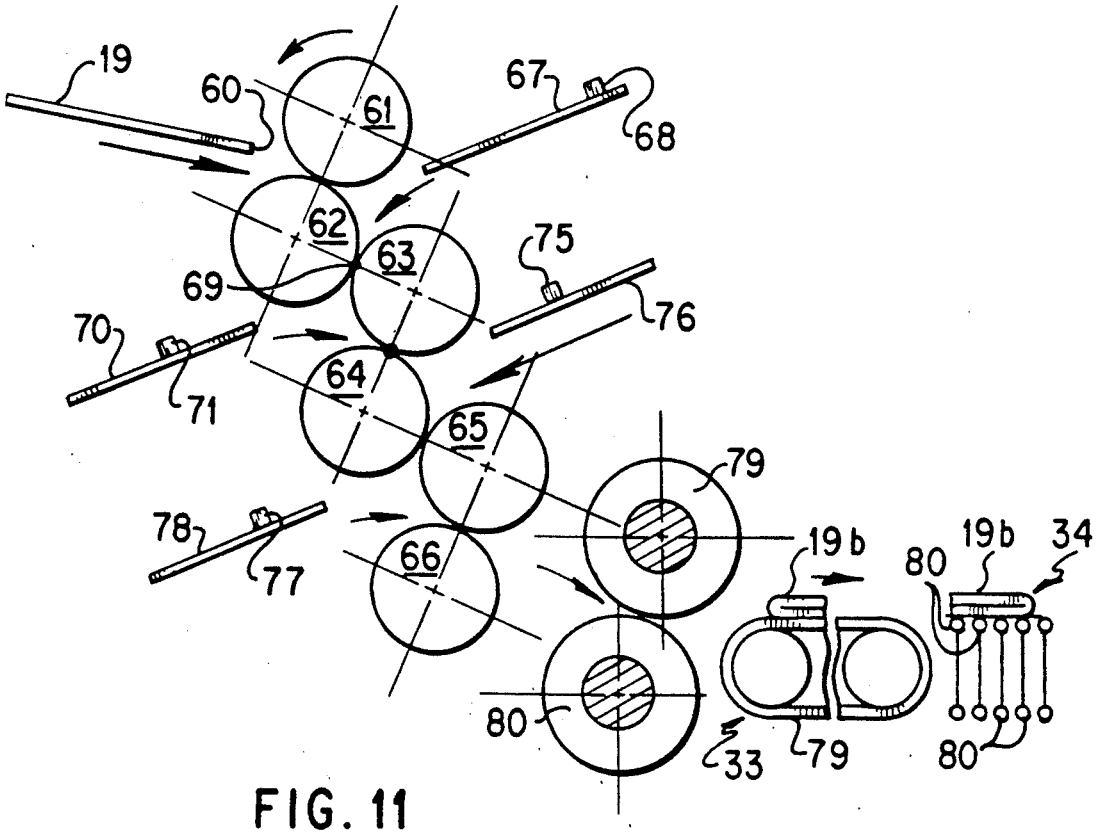
FIG. 11 is a diagrammatic view of the folding rollers and folding plates at the first folding station.
Figure 1A:
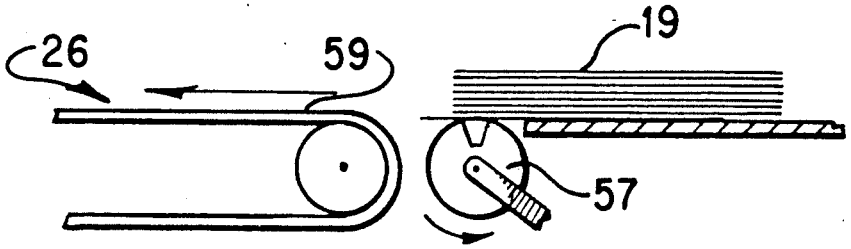
FIG. 1A illustrates the sheet feed from a stack of sheets.

Turning now to a more detailed description of the invention, the invention is embodied in a commercially available feeder 25 which is preferably a sheet feeder made by Griesser and Kunzmann GmbH of Wellendingen, West Germany which includes a stack supporting table 55, as best seen in FIG. 1, and a feed roller 56 which, as best seen in FIG. 1*a*, comprises a ported vacuum rotating roller 57 which will engage the leading edge of the lowest sheet 19 to pull it from the bottom of the stack and to feed it onto conveyor belts 59 of the first conveyor 26. For each rotation of the vacuum feed roller 57, one sheet will be fed forwardly. The sheets are fed along a commercially available conveyor mechanism sold by the same company to the first folding station 27 at which the sheet 19 will have its leading edge 60, as best shown in FIG. 11 movable between folding rollers 61 and 62 and the sheet travels across a first folding plate 67 until the leading sheet edge 60 abuts a paper stop 68 which causes the sheet to buckle at about one-third of the trailing portion of the sheet and the buckled portion is gripped and is fed downwardly into the nip 69 between folding rollers 62 and 63 to form the first fold line Fl, shown in FIG. 3. From the rollers 62 and 63 shown in FIG. 11, the sheet travels to engage a plate to abut paper stop 71 on the plate 70 then the sheet buckles at about the one-third of the trailing portion of the sheet and the buckled portion is gripped and is fed through the nip between the rollers 63 and 64 to form the second fold line F2 shown in FIG. 4 whereby the sheet has now been folded to form three equal panels 20, 21 and 29, each of the same width and with the panels being pushed tightly against one another. The now folded sheet hits a deflector 75 on the plate 76 and moves back through the nip of the rollers 64 and 65 to hit a further deflector stop 77 on a deflector plate 78. The folded sheet then travels through the nip of rollers 65 and 66 to a pair of scoring rollers 79 and 80 which have male and female blades that indent or otherwise crease or score the folded sheet with the score lines S1, S2 and S3, as shown in FIG. 5. The subsequent cross folds will be made at score lines S1, S2 and S3 as will be described.

Figure 10:
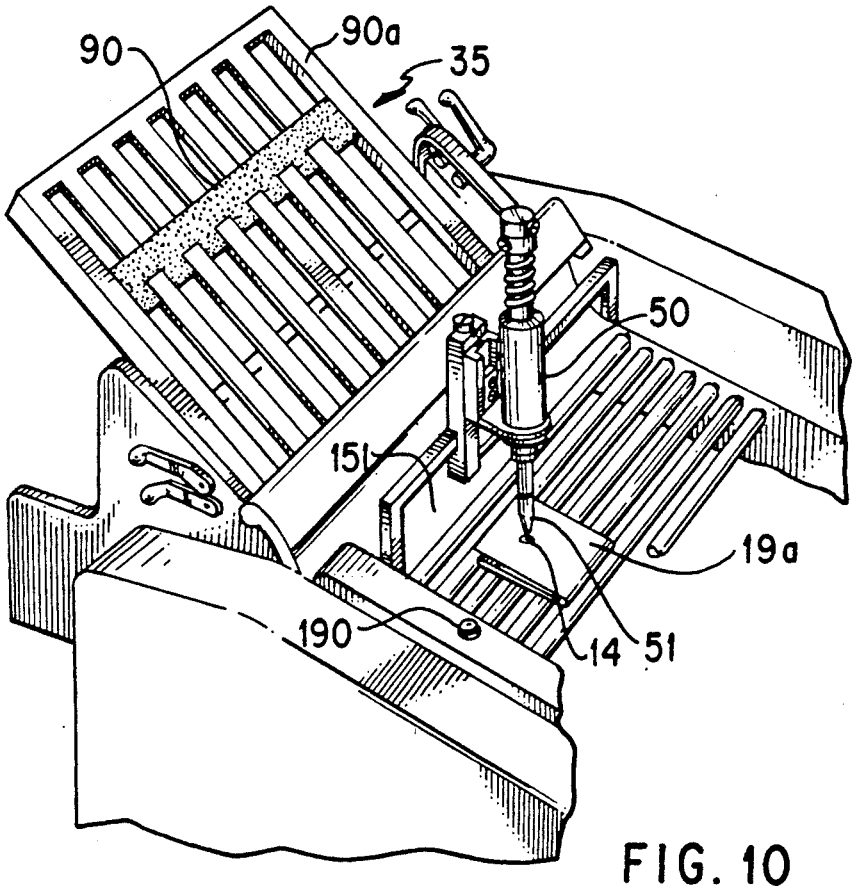
FIG. 10 is a fragmentary perspective view of the glueing station.

Upon discharge from the first folding station shown in FIG. 11, the folded sheets 19*a* travel to the right as viewed in FIG. 11 to be discharged onto a conveyor strand or belt 82 running at right angles to the conveyor belts 83 extending from the first folding station to the cross or second feed conveyor 34. Thus, the sheets on the conveyor 33 are transferred at the transfer station onto the belts in the second cross feed conveyor 34 for conveying towards the second folding station 35 and the gluing station 45. Prior to reaching the second folding station, the folded sheet is supplied with an adhesive dot 14 by the power-operated gluing device 50 preferably of the construction shown in FIG. 10. More specifically, as shown in FIG. 10, a spot of adhesive 14 is applied by the solenoid-operated gluing applicator 50 to the lip 39 on the inwardly facing surface of loose panel 22 of the longer leg 40.

Figure 12:
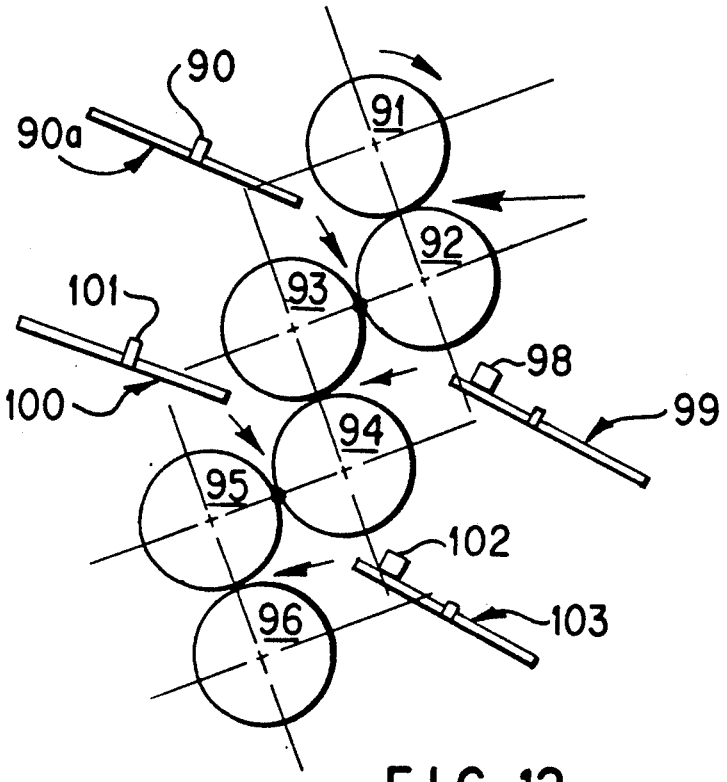
FIG. 12 is a diagrammatic view of the folding rollers and folding plates at the second folding station.

The preferred manner of application of the adhesive is made just prior to the second folding station 35. The latter includes four sets of folding rollers 93–94 (FIG. 12) each of which is suitably grooved and aligned with the glue spot 14 so that the glue spot will not hit a folding roller or spread glue on the rollers. The first cross fold which is formed at the fold line F3, as best seen in FIG. 7, will be formed with the leg 39 is significantly shorter than the leg 40 with the lip 42 on the leg carrying the glue spot. The leading edge of the folded sheet 19*a* moves through the nip of roller 91 and 92 and up the folding plate 90*a* to hit the paper stop 90 and to buckle at the score line S2 and the buckled portion is gripped by the folding rollers 92 and 93 and the first cross fold is made at the fold line F3 to form the folded sheet with the long and short legs, as seen in FIGS. 7 and 7*a*. The now folded sheet having the first cross fold F3 moves this fold to hit the deflector 98 on a plate 99. This causes the folded sheet to move through the nip of rollers 93 and 94 to engage paper stop 101 on folding plate 100 and causes the folded sheet to buckle at score lines S1 and S3 (FIG. 7) and this buckled portion is gripped between the rollers 94 and 95 to form the fold lines F4 and F5 shown in FIG. 8 and then to hit the deflecter 102 on the deflecter plate 103 and to move between the compressing rollers 95 and 96 which force the glue spot 14 against the surface of the opposing section 16 to form the completed leaflet shown in FIG. 9. As can be understood from FIGS. 8, 9 and 8A, the outer edges 17 and 18 of the long leg 40 are held together while there is a loose inwardly facing sheet or panel on which is adhered the glue spot 14. Thus, there is a double paper thickness panel joined by folded edges 17 on the outside of the first half 15 which is located on the longer leg and there is a loose panel 22 which is located inwardly. Likewise, double paper thickness panel joined by folded edges 18 on the outside of the second half 16 of the leaflet. The glue spot 14 extends over the top edge 39*a* of the now center section 39*b* shown in FIG. 8. Thus, the halves 15 and 16 are adhered to each other to make the final leaflet. Thus, the completed leaflet has no single loose panel on the outside thereof.

Figure 13:
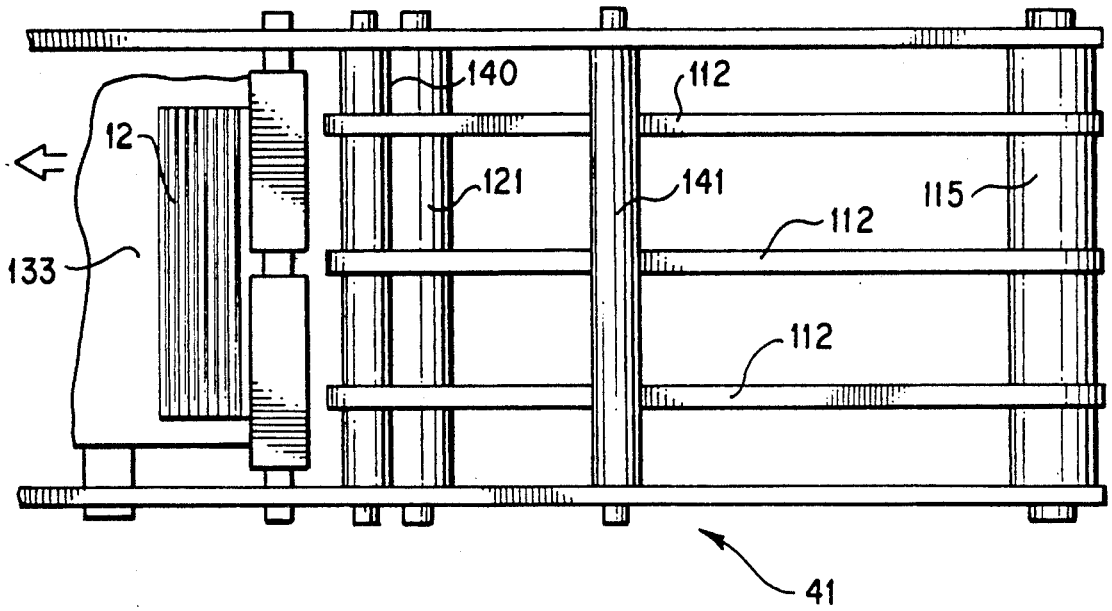
FIG. 13 is a plan view of the stacker.
Figure 14:
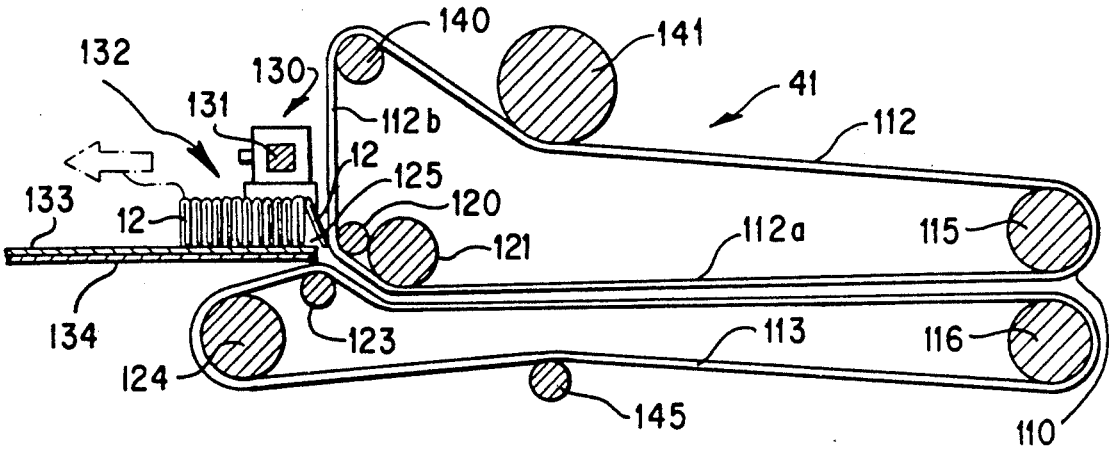
FIG. 14 is a cross sectional view of the stacker.

From the second folding station 35 the now completed leaflet 12 is discharged from the transfer rollers 95 and 96 of the folder 36 into a nip 110 between a pair of stacker belts 112 and 113 which carry the leaflets to the left as viewed in FIG. 13 and 14 between facing runs 112*a* and 113*a* of the respective belts 112 and 113.

As the conveyor belts 112 and 113 travel to the left, as viewed in FIGS. 13 and 14, their orientation changes as does the orientation of the leaflets from a horizontal travel along a path between facing runs 112*a* and 113*a* to a vertical orientation at the left end of FIGS. 13 and 14. The belt 112 is mounted and driven about a suitable drive drum or roller 115, while the other belt 113 is entrained about a lower roller 116 which is parallel to the upper roller 115. From these rollers, the respective belts 112 and 113 travel along their respective runs 112*a* and 113*a* to pairs of upper and lower discharge rollers 120 and 121 for the belt 112 and rollers 123 and 124 for the lower belt 113. The belts change their direction of travel at the smaller rollers 120 and 123 to direct a discharging leaflet upwardly into a mouth 125 between the upwardly traveling belt sections. The upper belt continues on an upper vertical run 112*b* and the preceding leaflets 12 hold the leaflet in frictional engagement with the upward run 112*b* so that the upper edge of the belt hits against a stop 130 mounted on a bar 131 thereby stripping the leaflet and holding the same against upward movement due to frictional engagement between the belt and the leaflet. The leaflets are preferably accummulated in a row 132 in a box 133 mounted on a horizontal supporting plate 134. Thus, each successive leaflet moving into the mouth 125 pushes a preceding leaflet to the left as viewed in FIG. 14 to slide the preceding leaflet forwardly in the box thereby forming a progressively long row. If desired, a conveyor belt could be placed underneath the lower edges of the row of leaflets to assist in pushing them to the left.

From the upward run portion 112*b*, the upper belt moves over an upper small guide roller 140 and then beneath the surface of a larger roller 141 to return to the drive roller 115. After the lower belt 113 passes over the small roller 123 it turns about a roller 124 and then extends over the top of another small roller 145 to return to its drive roller 116.

Figure 15:
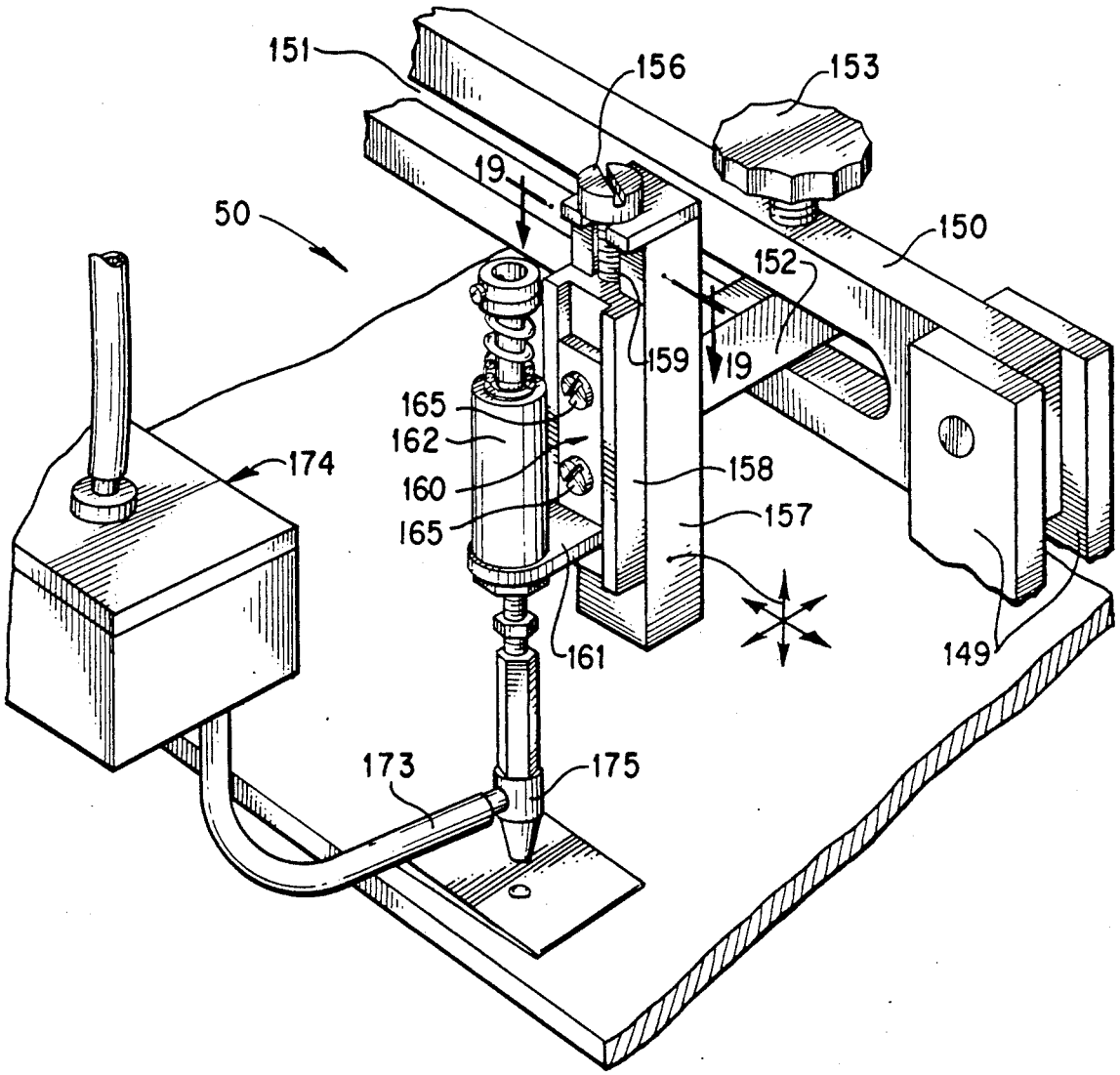
FIG. 15 is a diagrammatic perspective view of the glueing solenoid apparatus.
Figure 17:
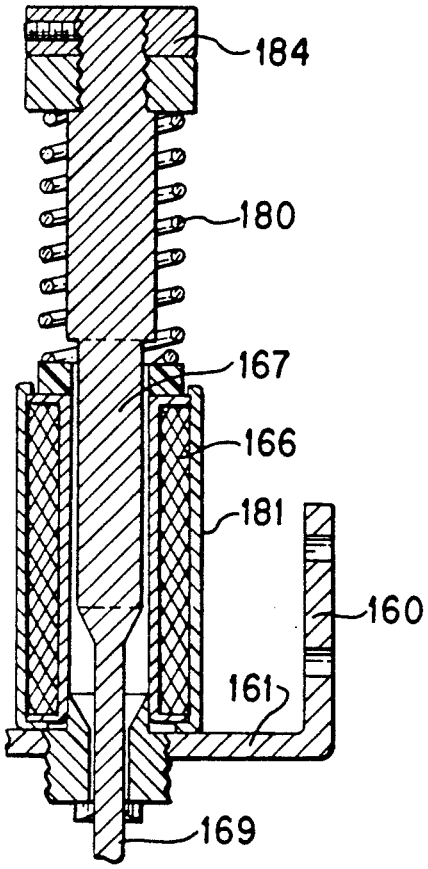
FIG. 17 is a cross sectional view of the solenoid for the glue nozzle.
Figure 18:
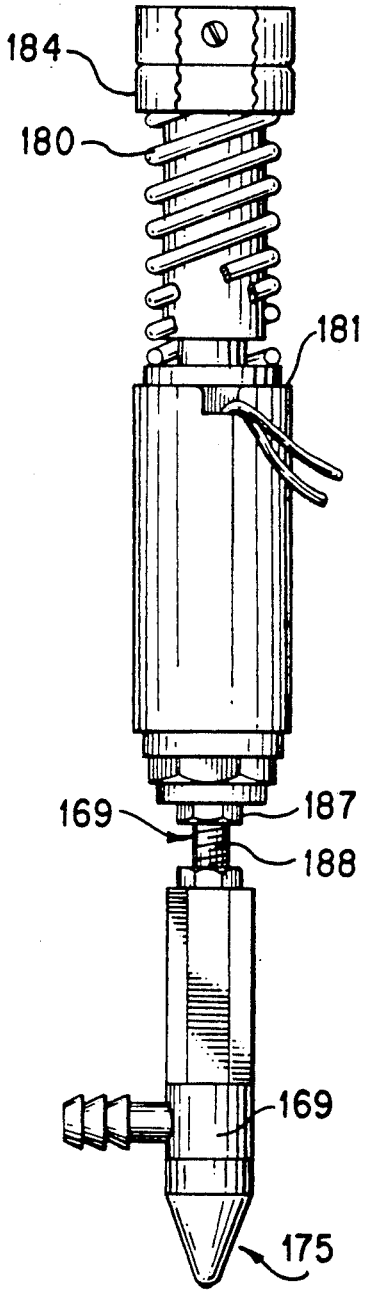
FIG. 18 is an elevational view of the glue solenoid and nozzle.
Figure 16:
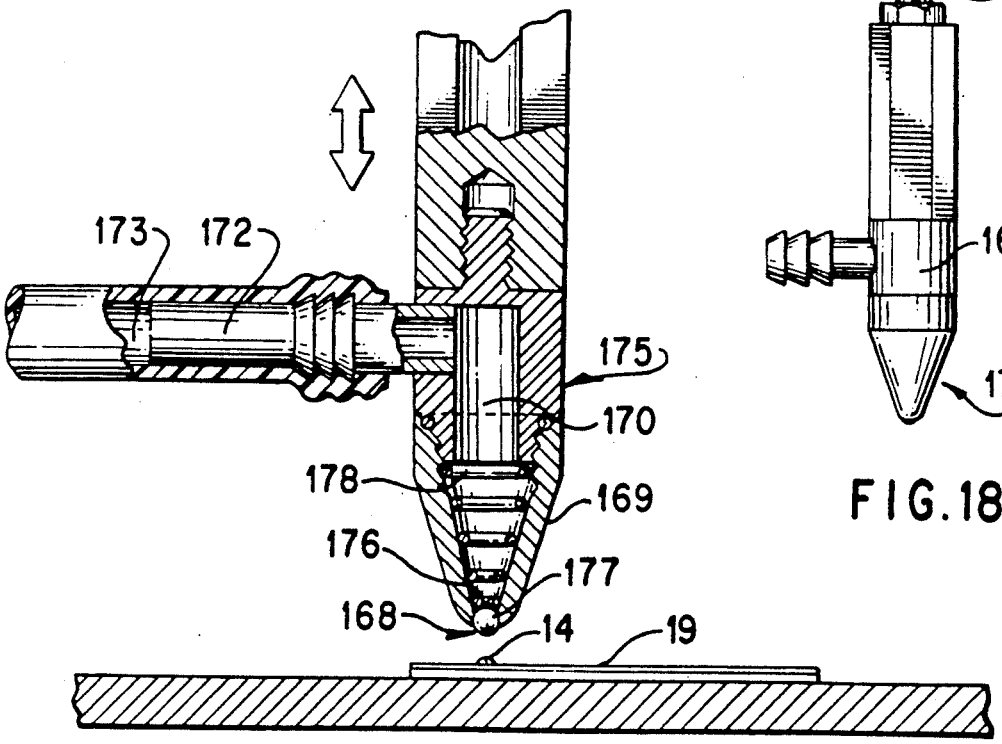
FIG. 16 is an enlarged partially sectioned view of the glue nozzle.

Further, a detailed view of the preferred glue applicator 50 used to supply the glue is shown in FIGS. 15, 16 and 17. The glue applicator is preferably mounted on a horizontal support bar 150 supported by a pair of vertical stands 149. As best seen in FIG. 15, the horizontal bar has a slot 151 into which projects a bracket arm 152, which carries the solenoid, and the bracket arm may be moved transversely along the slot and locked at a given spot by a threaded lock nut 153. Vertical adjustment of the solenoid is accomplished by turning the threaded screw 156 mounted in a stationary bracket 157 to move a slide 158 movable in a track 159 in the vertical bracket 157. By turning the screw, the slide 158 may be moved vertically. Another vertical adjustment may be made by sliding vertically a leg 160 of a support bracket 161 in the slide 158. A pair of set screws 165 may be used to lock the leg 160 in a vertically adjusted position in the slide 158.

The bracket 161 carries a solenoid 162 which is operable at high rates of speeds such as 1100 strokes per minute. As best seen in FIG. 17, the energization of the solenoid coil 166 will cause the solenoid plunger 167 to move downwardly and carry downwardly the glue dispensing valve 168 fixed to the lower end 169 of the solenoid plunger 167. The valve 168 includes as best seen in FIG. 16 a hollow bore 170 which is coupled to an inlet 172 to a hollow flexible tube 173 extending to a reservoir 174 of glue. Glue from the reservoir flows from the tube 173 into the bore 170 in the lower nozzle head 175 as best seen in FIG. 16. A dispensing valve at the lower end of the dispensing head 175 includes a glue dispensing orifice 176 having a captured ball 177 within the nozzle and biased by a spring 178 to close the orifice 176. When the solenoid plunger moves downwardly, the ball engages the folded sheet 19 and applies a spot of glue 14. Upon upward movement of solenoid plunger, the spring 178 pushes the ball 177 to close the orifice 176 to prevent further gluing. The solenoid is returned in an upward direction by a spring 180 positioned between the solenoid housing 181 and an upper end 184 on the plunger. A suitable adjustment screw 187, FIG. 15, is mounted on a lower threaded portion 188 of the plunger 167 to limit the amount of travel on the solenoid in an adjustible manner.

Manifestly, other glue or hot melt applicators may be used other than the illustrated solenoid device. For example, some glue applicators use a compressed air spray of glue. It is preferred to have an electrical photo cell 190 as best seen in FIG. 10 to spot the location of the incoming folded sheet 19 and then to operate the solenoid to apply the glue.

While the preferred embodiment has double panels and double folded edges on the outside of the leaflet, it is to be understood that the apparatus and method may be used to form leaflets in which a single panel is on the outside of the leaflet when this construction does not result in problems particularly with a later packaging machine operation. Although, the preferred embodiment has been shown and described as having three initial folds in the sheet of paper manifestly the number of initial folds may be varied from the three folds shown herein. Likewise, the number of cross folds may also be varied to include more additional folds than have been shown herein. These and other modifications of the leaflet may be accomplished and still fall within the purview of the appended claims.

While a preferred embodiment has been shown and described, it will be understood that there is no intent to limit the invention by such disclosure, but rather, it is intended to cover all modifications and alternate constructions falling within the spirit and scope of the invention as defined in the appended claims.

I claim:

1. In an apparatus for folding a folded, enclosed leaflet formed from an integral sheet having fold lines and cross folds normal to the fold lines therein and having adhesive interior of the leaflet to join folded halves of the leaflet together, the leaflet having an interior lip portion and having cross folds and fold lines along exterior edges of the leaflet so as not to leave a loose edge on the leaflet, said apparatus comprising:

first conveyor means for feeding sheets in a first direction to a first folding station, a first folding means at the first folding station for folding the sheet with fold lines extending normal to the direction of travel of the sheet into the folding station, means for delivery of the folded sheets with fold lines to the transfer station, second conveyor means for feeding the folded sheets in a direction substantially at right angles to the first direction of travel, adhesive application means for applying adhesive to a portion of the folded sheet, second folder means at a second folding station to fold the folded sheet in a direction perpendicular to the fold lines formed at the first folding station thereby forming cross folds and including means to form one leg longer than the other leg to leave a lip portion on the longer leg, and said second folder means including a folder to make a final cross fold which joins the leaflet halves together and to push the lip portion against a folded panel to adhere the latter to the lip portion to form a folded leaflet with adhered panels and without a loose edge.

2. An apparatus in accordance with claim 1 including stacker means to stack the folded leaflets on edge in a row.

3. An apparatus in accordance with claim 1 including means for holding a stack of sheets and a means for feeding a sheet from the bottom of the stack onto the first conveyor means.

4. An apparatus in accordance with claim 1 in which said folders at said first station comprise a set of folding rollers and folding plates for forming a first fold line and a second fold line in said sheets and includes means for discharging the sheets from the folding rollers with a fold line leading in the direction of travel of the folded sheet so as not to have a loose edge which may open.

5. An apparatus in accordance with claim 4 in which said second folder means comprises a plurality of folding rollers and folding plates for folding the folded sheet to have closed edges all the way around and with the loose edge on the inside of the leaflet so that there is no single edge open and sticking out from the folded leaflet.

6. A method of folding sheets at high speeds with automatic equipment to form leaflets having adhered panels facing each other, said method comprising the steps of:

feeding sheets forwardly from a stack to a first folding station, at the first folding station folding the sheet a plurality of times, feeding the folded sheet from the first folding station forwardly with a closed folded edge leading in the travel direction, transferring the folded sheets at a transfer station for travel in a direction to right angles in the first direction of travel, applying adhesive to the folded sheet at a predetermined location, traveling folded sheet forwardly to a second folding station and folding the folded sheet with a first short leg and a second longer leg leaving a lip portion on the longer leg, and folding the folded sheets again to bring a portion of the second let against the lip portion with an adhesive adhering the lip portion to the folded panel to complete the folded leaflet.

7. A method in accordance with claim 6 including the step of discharging the leaflets from the second folding station and automatically stacking the folded leaflets on edge in a row at a stacking station.

8. In an apparatus for folding a folded, enclosed leaflet formed from an integral sheet having fold lines and cross folds normal to the fold lines therein and having adhesive interior of the leaflet to join folded halves of the leaflet together, the leaflet having an interior lip portion and having cross folds and fold lines along exterior edges of the leaflet so as not to leave a loose edge on the leaflet, first conveyor means for feeding sheets in a first direction to a first folding station, a first folding means at the first folding station for folding the sheet with a fold lien extending normal to the direction of travel of the sheet into the folding station, means for delivery of the folded sheets to a transfer station, second conveyor means for feeding the folded sheets in a direction substantially at right angles to the first direction of travel, adhesive application means for applying adhesive to a portion of the folded sheet, second folder means at a second folding station to fold the folded sheet in a direction perpendicular to the fold line formed at the first folding station thereby forming cross folds and including means to form one leg longer than the other leg to leave a lip portion on the longer leg, said second folder means including a folder to make a final cross fold and to push the lip portion against a a folded panel to adhere the latter to the lip portion to form a folded leaflet with adhered panels and without a loose edge, and stacker means for stacking the folded leaflets in a stack or row.

9. A method of folding sheets at high speeds with automatic equipment folding a folded, enclosed leaflet formed from an integral sheet having fold liens and cross folds normal to the fold lines therein and having adhesive interior of the leaflet to join folded halves of the leaflet together, the leaflet having an interior lip portion and having cross folds and fold lines along exterior edges of the leaflet so as not to leave a loose edge on the leaflet, said method comprising the steps of:

feeding sheets forwardly from a stack to a first folding station, at the first folding station folding the sheet a plurality of times while forming fold lines in the sheet, feeding the folded sheet from the first folding station forwardly with a closed folded edge leading in the travel direction, transferring the folded sheets at a transfer station for travel in a direction to right angles in the first direction of travel, applying adhesive to the folded sheet at a predetermined location, traveling folded sheet forwardly to a second folding station and folding the folded sheet in a direction perpendicular to the fold lines formed at the first folding station thereby forming cross folds and at the second folding station forming a first short leg and a second longer leg leaving a lip portion on the longer leg, folding the folded sheets again at the second folding station to bring a portion of the second leg against the lip portion with an adhesive adhering the lip portion to the folded panel to complete the folded leaflet without a loose edge thereon, and automatically stacking the leaflets in a stack or row.

* * * * *